US006378962B1

(12) United States Patent
Green

(10) Patent No.: US 6,378,962 B1
(45) Date of Patent: Apr. 30, 2002

(54) DISPLAY CASE

(76) Inventor: Lonnie W. Green, 5905 US 79 East, Henderson, TX (US) 75652-7111

( * ) Notice: Subject to any disclaimer, the term of this patent is extended or adjusted under 35 U.S.C. 154(b) by 0 days.

(21) Appl. No.: 09/677,001

(22) Filed: Sep. 29, 2000

(51) Int. Cl.[7] ..... A47F 9/00

(52) U.S. Cl. ..... 312/137; 312/196; 292/DIG. 49; 292/247; 292/66

(58) Field of Search ..... 312/114, 137, 312/196, 140.4; 108/90; 292/DIG. 49, 246, 247, 66; 403/384, 403, 345

(56) References Cited

U.S. PATENT DOCUMENTS 1,109,339 A * 9/1914 Klein ..... 312/137
1,308,312 A * 7/1919 Weber ..... 312/137
1,379,553 A * 5/1921 Gloekler ..... 312/137
2,690,921 A * 10/1954 Braun ..... 292/DIG. 49 X
3,748,006 A * 7/1973 Levit et al. ..... 312/196 X
4,128,285 A * 12/1978 Lore et al. ..... 312/196

FOREIGN PATENT DOCUMENTS

CA 642966 * 6/1962 ..... 312/196
DE 300423 * 7/1954 ..... 312/127

* cited by examiner

*Primary Examiner*—Janet M. Wilkens

(57) ABSTRACT

A display case for preventing the loss and damage to items on a table due to adverse weather. The display case includes a top wall, a front wall, a first side wall and a second side wall. A lip is integrally coupled to and extends downwardly from a back edge of the top wall. The top wall, the side walls, the flanges and the lip are each generally transparent. A plurality of securing members releasably secure the side walls to a peripheral edge of a table.

7 Claims, 2 Drawing Sheets

10
44
24
28
2
2
46
26
46
16
39
8
6

42
36
40
38
26
34
30
32
30
28

DISPLAY CASE

BACKGROUND OF THE INVENTION

1. Field of the Invention

The present invention relates to display cases and more particularly pertains to a new display case for preventing the loss and damage to items on a table due to adverse weather.

2. Description of the Prior Art

The use of display cases is known in the prior art. More specifically, display cases heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,832,943; U.S. Pat. No. 4,883,001; U.S. Pat. No. 4,789,019; U.S. Pat. No. 3,782,435; U.S. Pat. No. 5,377,829; and U.S. Des. Pat. No. 306,669.

While these devices fulfill their respective, particular objectives and requirements, the aforementioned patents do not disclose a new display case. The inventive device includes a top wall, a front wall, a first side wall and a second side wall. A lip is integrally coupled to and extends downwardly from a back edge of the top wall. The top wall, the side walls, the flanges and the lip are each generally transparent. A plurality of securing members releasably secure the side walls to a peripheral edge of a table.

In these respects, the display case according to the present invention substantially departs from the conventional concepts and designs of the prior art, and in so doing provides an apparatus primarily developed for the purpose of preventing the loss and damage to items on a table due to adverse weather.

SUMMARY OF THE INVENTION

In view of the foregoing disadvantages inherent in the known types of display cases now present in the prior art, the present invention provides a new display case construction wherein the same can be utilized for preventing the loss and damage to items on a table due to adverse weather.

The general purpose of the present invention, which will be described subsequently in greater detail, is to provide a new display case apparatus and method which has many of the advantages of the display cases mentioned heretofore and many novel features that result in a new display case which is not anticipated, rendered obvious, suggested, or even implied by any of the prior art display cases, either alone or in any combination thereof.

To attain this, the present invention generally comprises a top wall, a front wall, a first side wall and a second side wall. A lip is integrally coupled to and extends downwardly from a back edge of the top wall. The top wall, the side walls, the flanges and the lip are each generally transparent. A plurality of securing members releasably secure the side walls to a peripheral edge of a table.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new display case apparatus and method which has many of the advantages of the display cases mentioned heretofore and many novel features that result in a new display case which is not anticipated, rendered obvious, suggested, or even implied by any of the prior art display cases, either alone or in any combination thereof.

It is another object of the present invention to provide a new display case which may be easily and efficiently manufactured and marketed.

It is a further object of the present invention to provide a new display case which is of a durable and reliable construction.

An even further object of the present invention is to provide a new display case which is susceptible of a low cost of manufacture with regard to both materials and labor, and which accordingly is then susceptible of low prices of sale to the consuming public, thereby making such display case economically available to the buying public.

Still yet another object of the present invention is to provide a new display case which provides in the apparatuses and methods of the prior art some of the advantages thereof, while simultaneously overcoming some of the disadvantages normally associated therewith.

Still another object of the present invention is to provide a new display case for preventing the loss and damage to items on a table due to adverse weather.

Yet another object of the present invention is to provide a new display case which includes a top wall, a front wall, a first side wall and a second side wall. A lip is integrally coupled to and extends downwardly from a back edge of the top wall. The top wall, the side walls, the flanges and the lip are each generally transparent. A plurality of securing members releasably secure the side walls to a peripheral edge of a table.

Still yet another object of the present invention is to provide a new display case that is retrofittable to existing tables.

Even still another object of the present invention is to provide a new display case that has an open back side and is divided into two portions for easy placement of items on the table.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
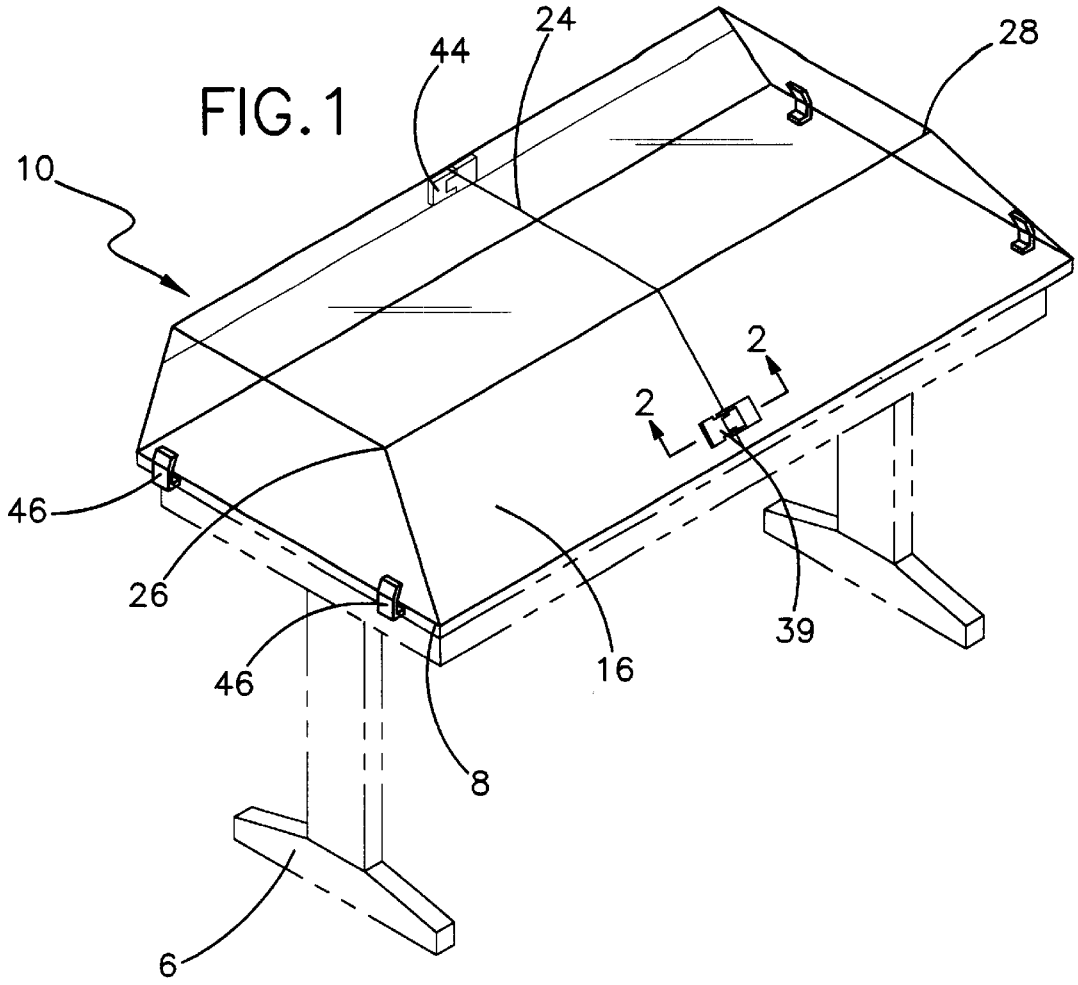
FIG. 1 is a schematic perspective view of a new display case according to the present invention.
Figure 2:
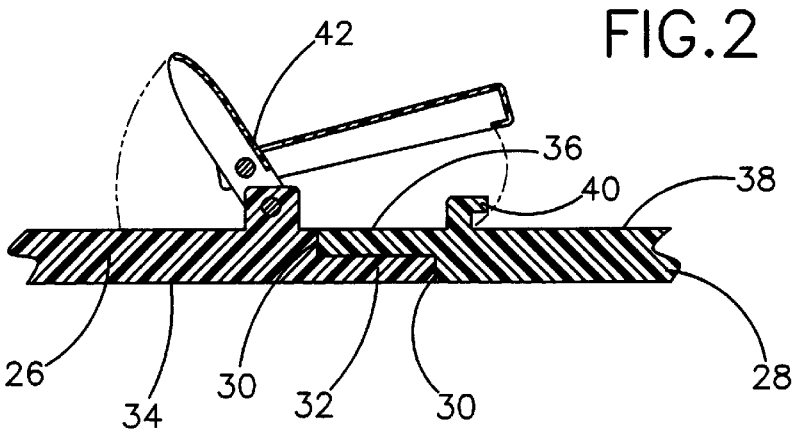
FIG. 2 is a schematic crosss-sectional view along line 2—2 of the present invention.
Figure 3:
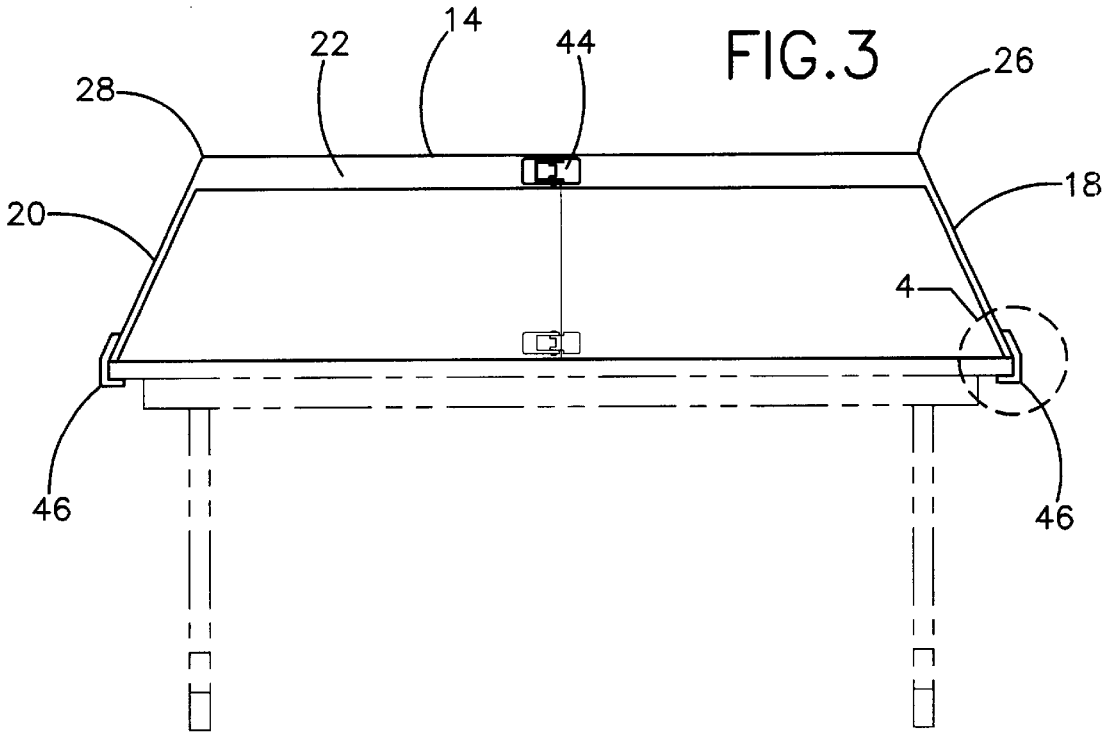
FIG. 3 is a schematic back view of the present invention.
Figure 4:
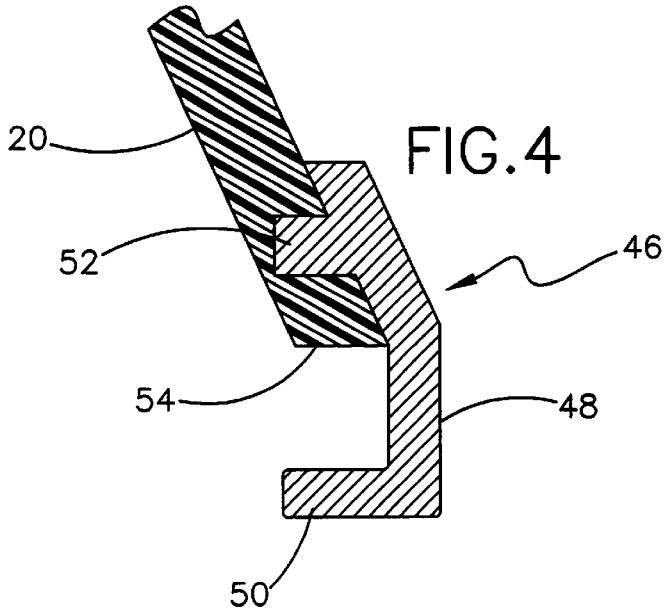
FIG. 4 is a schematic cross-sectional view of a securing member of the present invention.

With reference now to the drawings, and in particular to FIGS. 1 through 4 thereof, a new display case embodying the principles and concepts of the present invention and generally designated by the reference numeral 10 will be described.

As best illustrated in FIGS. 1 through 4, the display case 10 generally comprises a top wall 14, a front wall 16, a first side wall 18 and a second side wall 20. A lip 22 is integrally coupled to and extends downwardly from a back edge of the top wall 14. A slit 24 extends through the lip 22, top wall 14 and front wall 16 such that a right portion 26 and a left portion 28 of the device 10 are defined. Each of the portions 26, 28 has a peripheral side edge 30 defined by the slit 24. The peripheral side edge 30 of the right portion 26 has a flange 32 extending away therefrom which is positioned adjacent to an inner surface 34 of the right portion 26. The peripheral side edge 30 of the left portion 28 has a corresponding flange 36 extending away therefrom that is positioned adjacent to an outer surface 38 of the left portion 28. The flanges 32, 36 may be engaged when the peripheral side edges 26, 28 are abutted. The front wall 16 preferably tapers outwardly such that the first 18 and second 20 side walls are generally trapezoidal shaped. The front wall 16, the top wall 14 the side walls 18, 20, the flanges 32, 36 and the lip are each generally transparent and preferably comprise a plastic material.

A first coupling member 39 comprises a protruding member 40 and a latch portion 42. The protruding member 40 is integrally coupled to and extends away from an outer surface of the front wall 16 of the left portion 28. The protruding member 40 is positioned generally adjacent to the peripheral side edge 30 of the left portion 28. The latch portion 42 is hingedly coupled to the outer surface of the right portion 26 and is positioned to releasably engage the protruding member 40.

A second coupling member 44 comprises a protruding member 40 and a latch portion 42. The protruding member of the second coupling member is integrally coupled to and extends away from the outer surface of the lip 22 of the right portion. The protruding member 40 is positioned generally adjacent to the peripheral side edge of the right portion. The latch portion 42 is hingedly coupled to the outer surface of the left portion and, is positioned to releasably engage the protruding member of the second coupling member 44.

A plurality of securing members 46 releasably secure the side walls 18, 22 to the peripheral edge of a table 6. Each of the securing members has a leg portion 48 and a foot portion 50. Each of the leg portions 48 has a nub 52 thereon that extends away from the leg portions 48 in generally the same direction of the foot portions 50. Each of the nubs 52 extends into and is removably attached to an outer surface of one of the side walls 18, 20 such that the foot portions 50 traverse a bottom edge 54 of the side walls 18, 20. A peripheral edge 8 of the table 6 is positioned between the bottom edges 54 of the side walls and the foot portions 50.

In use, the right 18 and left 20 portions are positioned on the table 6 and abutted against each other so that the flanges 32, 36 are engaged. The coupling members 39, 44 couple the left and right portions together. The securing members 46 secure the side walls to a peripheral edge 8 of a table 6. The back side of the device 10 is open to allow a user to place items within. The lip 22 adds increased strength to the device so that items placed on the top wall will not bend the top wall downward. The device is placed on portable tables that are outside to prevent the wind from blowing away items, such as leaflets, off of the table.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable display case device, said device being removably coupled to the peripheral edge of a table, said device comprising:

a top wall, a front wall, a first side wall and a second side wall, a lip being integrally coupled to and extending downwardly from a back edge of said top wall, said top wall, said side walls, and said lip each being generally transparent, a slit extending through said lip, top wall and front wall such that a right portion and a left portion of said device are defined, each of said portions having a peripheral side edge defined by said slit, said peripheral side edge of said right portion having a flange extending away therefrom and positioned adjacent to an inner surface of said right portion, said peripheral side edge of said left portion having a corresponding flange extending away therefrom and positioned adjacent to an outer surface of said left portion, wherein said flanges may be engaged when said peripheral side edges are abutted; and a plurality of securing members for releasably securing said side walls to the peripheral edge of said table.

2. The portable display case device as in claim 1, wherein each of said securing members has a leg portion and a foot portion, each of said leg portions having a nub thereon extending away from said leg portions in generally the same direction of said foot portions, each of said nubs extending into and being removably attached to an outer surface of one of said side walls such that said foot portions traverse a bottom edge of said side walls, wherein the peripheral edge of said table is positioned between said bottom edges of said side walls and said foot portions.

3. The portable display case device as in claim 1, further comprising a first coupling member for coupling said right portion of said front wall to said left portion of said front wall.

4. The portable display case device as in claim 3, further comprising a second coupling member for coupling said right portion of said lip to said left portion of said lip.

5. The portable display case device as in claim 4, wherein said first and second coupling members each includes a protruding member and a latch portion, said protruding member of said first coupling member being integrally coupled to and extending away from an outer surface of said front wall of said left portion and being positioned generally adjacent to said peripheral side edge of said right portion, said latch portion of said first coupling member being hingedly coupled to said outer surface of said right portion and being positioned to releasably engage said protruding member, said protruding member of said second coupling member being integrally coupled to and extending away from the outer surface of said lip of said right portion and being positioned generally adjacent to said peripheral side edge of said right portion, said latch portion of said second coupling member being hingedly coupled to said outer surface of said left portion and being positioned to releasably engage said protruding member of said second coupling member.

6. The portable display case device as in claim 3, wherein said front wall tapers outwardly such that said first and second side walls are generally trapezoidal shaped.

7. A portable display case device, said device being removably coupled to the peripheral edge of a table, said device comprising:

a top wall, a front wall, a first side wall and a second side wall, a lip being integrally coupled to and extending downwardly from a back edge of said top wall, a slit extending through said lip, top wall and front wall such that a right portion and a left portion of said device are defined, each of said portions having a peripheral side edge defined by said slit, said peripheral side edge of said right portion having a flange extending away therefrom and positioned adjacent to an inner surface of said right portion, said peripheral side edge of said left portion having a corresponding flange extending away therefrom and positioned adjacent to an outer surface of said left portion, wherein said flanges may be engaged when said peripheral side edges are abutted, said front wall tapering outwardly such that said first and second side walls are generally trapezoidal shaped, said front wall, said top wall, said side walls, said flanges and said lip each being generally transparent;

a first coupling member comprising a protruding member and a latch portion, said protruding member being integrally coupled to and extending away from an outer surface of said front wall of said right portion, said protruding member being positioned generally adjacent to said peripheral side edge of said right portion, said latch portion being hingedly coupled to said outer surface of said left portion and being positioned to releasably engage said protruding member;

a second coupling member comprising a protruding member and a latch portion, said protruding member of said second coupling member being integrally coupled to and extending away from the outer surface of said lip of said right portion, said protruding member being positioned generally adjacent to said peripheral side edge of said right portion, said latch portion being hingedly coupled to said outer surface of said left portion and being positioned to releasably engage said protruding member of said second coupling member; and a plurality of securing members for releasably securing said side walls to the peripheral edge of said table, each of said securing members having a leg portion and a foot portion, each of said leg portions having a nub thereon extending away from said leg portions in generally the same direction of said foot portions, each of said nubs extending into and being removably attached to an outer surface of one of said side walls such that said foot portions traverse a bottom edge of said side walls, wherein the peripheral edge of said table is positioned between said bottom edges of said side walls and said foot portions.

* * * * *